US008732897B2

(12) United States Patent
Jung et al.

(10) Patent No.: US 8,732,897 B2
(45) Date of Patent: May 27, 2014

(54) AUTONOMOUS CLEANING DEVICE

(75) Inventors: Hyun Soo Jung, Seongnam-si (KR); Seung Il Han, Sosa-gu (KR); Dong Won Kim, Hwaseong-si (KR); Bo Sang Kim, Gwangiu (KR); Jun Hwa Lee, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/596,556

(22) Filed: Aug. 28, 2012

(65) Prior Publication Data

US 2012/0317745 A1 Dec. 20, 2012

Related U.S. Application Data

(62) Division of application No. 13/279,892, filed on Oct. 24, 2011.

(30) Foreign Application Priority Data

Oct. 25, 2010 (KR) ..... 10-2010-0103778
Aug. 26, 2011 (KR) ..... 10-2011-0086080

(51) Int. Cl.
*A47L 5/00* (2006.01)

(52) U.S. Cl.
USPC ..... 15/319; 15/93.1; 15/401

(58) Field of Classification Search
USPC ..... 15/319, 320, 322, 93.1, 340.3, 401
IPC ..... A47L 5/00,9/28
See application file for complete search history.

(56) References Cited

U.S. PATENT DOCUMENTS

| | | | | |
|---|---|---|---|---|
| 3,460,188 | A * | 8/1969 | Boyd | 15/364 |
| 4,709,436 | A | 12/1987 | Berfield et al. | |
| 4,864,682 | A * | 9/1989 | Bewley et al. | 15/371 |
| 5,054,156 | A * | 10/1991 | Watanabe et al. | 15/325 |
| 2005/0229340 | A1 | 10/2005 | Sawalski et al. | |
| 2007/0143954 | A1 | 6/2007 | Graham et al. | |

FOREIGN PATENT DOCUMENTS

| | | | |
|---|---|---|---|
| CA | 2198404 | | 8/1998 |
| EP | 0705560 | A1 | 4/1996 |
| KR | 10-2008-0058856 | | 6/2008 |
| KR | 10-2009-0063334 | | 6/2009 |
| WO | 2005/077244 | A1 | 8/2005 |
| WO | 2009/086893 | A2 | 7/2009 |

OTHER PUBLICATIONS

U.S. Appl. No. 13/279,892, filed Oct. 24, 2011, Hyun Soo Jung et al., Samsung Electronics Co., Ltd.
Extended European Search Report mailed Sep. 13, 2013 in related European Application No. 11186505.1.
Extended European Search Report mailed Sep. 12, 2013 in related European Application No. 12182367.8.

* cited by examiner

*Primary Examiner* — David Redding
(74) *Attorney, Agent, or Firm* — Staas & Halsey LLP

(57) ABSTRACT

A blade assembly of an autonomous cleaning device. The blade assembly includes a blade having a first part fixed to the main body and a second part extended from the first part toward a floor and a support member having at least a portion disposed adjacent to the second part of the blade to restrict movement of the second part of the blade to within a predetermined range.

8 Claims, 15 Drawing Sheets

AUTONOMOUS CLEANING DEVICE

CROSS-REFERENCE TO RELATED APPLICATION

This application is a divisional of U.S. application Ser. No. 13,279,892 filed Oct. 24, 2011, which claims the priority benefit of Korean Patent Application No. 2010-0103778 and No. 2011-0086080, filed on Oct. 25, 2010 and Aug. 26, 2011 in the Korean Intellectual Property Office, the disclosure of which is incorporated herein by reference.

BACKGROUND

1. Field

Embodiments relate to an autonomous cleaning device wherein the structure of a blade assembly is improved, thereby improving cleaning efficiency.

2. Description of the Related Art

An autonomous mobile robot is a device that travels about an arbitrary area to perform a predetermined task without user manipulation. The robot may travel autonomously to a considerable extent, and autonomous travel may be embodied in various manners. For example, the robot may travel along a predetermined route using a map or may travel using a sensor to sense surroundings thereof without following a predetermined route.

An autonomous cleaning device travels about an area to be cleaned so as to clean a floor without user manipulation. Specifically, the autonomous cleaning device may function to remove dust or clean a floor at home. Here, dust may include dirt, motes, powder, fragments and other dust particles.

The autonomous cleaning device includes a brush unit to sweep up dust and a blade to guide the dust to a dust box. However, the distance between the blade and a floor is not adjusted. When the blade moves off of the floor, the dust is not properly guided, thereby lowering cleaning performance. When the blade comes into excessively tight contact with the floor, abnormal noise is generated.

SUMMARY

It is an aspect to provide an autonomous cleaning device having improved dust suction performance.

It is another aspect to provide an autonomous cleaning device that secures travel performance and cleaning performance irrespective of a floor state.

Additional aspects of the invention will be set forth in part in the description which follows and, in part, will be apparent from the description, or may be learned by practice of the invention.

In accordance with one aspect, an autonomous cleaning device includes a main body having an opening, a brush unit rotatably provided in the opening of the main body, and a blade assembly to guide introduction of dust swept up by the brush unit, wherein the blade assembly includes a blade having a first part fixed to the main body and a second part extended from the first part toward a floor and a support member provided at a rear of the blade in a travel direction of the main body to prevent the second part of the blade from being bent in a direction opposite to the travel direction of the main body.

The support member may include a first support part to contact the first part of the blade and a second support part which is adjacent to the second part of the blade.

The blade assembly may further include a fixing member having at least a portion disposed adjacent to the second part of the blade so that an end of the second part of the blade remains in tight contact with the floor.

The fixing member may include a first fixing part to contact the first part of the blade and a second fixing part which is adjacent to the second part of the blade.

The second part of the blade may include at least one moving portion, the second support part of the support member may be disposed adjacent to a lower side of the at least one moving portion, and the second fixing part of the fixing member may be disposed adjacent to an upper side of the at least one moving portion.

The distance between the second support part of the support member and the second fixing part of the fixing member may be greater than a thickness of the second part of the blade.

The second part of the blade may include a moving portion and a tight contact portion extended from the moving portion toward the floor, and the second support part of the support member may include a first movement restriction portion corresponding to the moving portion and a second movement restriction portion corresponding to the tight contact portion.

The second part of the blade may include a moving portion and a tight contact portion extended from the moving portion toward the floor, and the fixing member may include at least one guide smoothly connected to a guide of the tight contact portion.

The guide of the tight contact portion and the at least one guide of the fixing member may coincide with a rotational arc of the brush unit.

The second part of the blade may include a plurality of contact portions in tight contact with the floor, and the contact portions may simultaneously be in tight contact with the floor.

When at least one of the contact portions is positioned above a crevice of the floor, the remaining contact portions may support the at least one of the contact portions so that the at least one of the contact portions does not fall into the crevice.

A front one of the contact portions in a direction of travel may be formed in a quadrangular or wedge shape in section.

Each of the contact portions may include a first contact portion formed at the front end of the second part in a direction of travel so that the first contact portion protrudes downward and a horizontality maintaining portion to support the first contact portion so that the first contact portion is maintained horizontal even over a rugged floor.

The horizontality maintaining portion may be formed to cover the end of the second part at the rear of the first contact portion.

The distance from the bottom of the first contact portion to the floor may be equal to or less than the distance from the bottom of the horizontality maintaining portion to the floor.

The horizontality maintaining portion may be formed of a flexible material. In accordance with another aspect, an autonomous cleaning device includes a main body having an opening, a brush unit rotatably provided in the opening of the main body, and a blade to guide movement of dust swept up by the brush unit, wherein the blade includes a first part fixed to the main body, a second part extended from the first part toward a floor, and a plurality of contact portions formed at an end of the second part so that the contact portions contact the floor.

When at least one of the contact portions is positioned above a crevice of the floor, the remaining contact portions may support the at least one of the contact portions so that the at least one of the contact portions does not fall into the crevice.

The second part of the blade may include a first contact portion configured to tightly contact the floor and a second contact portion provided at a rear end of the first contact portion in a direction of travel to support the first contact portion so that the first contact portion does not fall into valleys of a rugged floor.

The autonomous cleaning device may further include a fixing member and a support member disposed adjacent to an upper side and a lower side of the blade to restrict movement of the blade to within a predetermined range.

The thickness of the blade may be less than the distance between the fixing member and the support member.

In accordance with another aspect, an autonomous cleaning device includes a main body having an opening, a brush unit rotatably provided in the opening of the main body, and a blade assembly to guide movement of dust swept up by the brush unit, wherein the blade assembly includes a blade having a first part fixed to the main body and a second part extended from the first part toward a floor and a fixing member disposed above the blade to push at least a portion of the second part of the blade so that an end of the second part of the blade remains in tight contact with the floor.

The blade assembly may further include a support member spaced apart from the second part of the blade to prevent the second part of the blade from being bent in a direction opposite to a direction of travel.

The second part of the blade may include at least one moving portion and at least one tight contact portion extended from the at least one moving portion toward the floor, and the support member may include at least one first movement restriction portion and at least one second movement restriction portion corresponding to the second part of the blade.

The blade assembly may further include a plurality of contact portions formed at the second part of the blade so that the contact portions are in tight contact with the floor, and, when at least one of the contact portions is positioned above a crevice of the floor, the remaining contact portions may support the at least one of the contact portions so that the at least one of the contact portions does not fall into the crevice.

The autonomous cleaning device may further include a plurality of contact portions formed at the second part of the blade so that the contact portions contact the floor, wherein each of the contact portions may include a first contact portion formed at a front of an end of the blade in a direction of travel so as to protrude downward so that the first contact portion tightly contacts the floor and a second contact portion provided at the rear end of the first contact portion in a direction of travel to support the first contact portion so that the first contact portion does not fall into valleys of a rugged floor.

In accordance with another aspect, an autonomous cleaning device includes a main body having an opening, a brush unit rotatably provided in the opening of the main body, and a blade to guide movement of dust swept up by the brush unit, wherein the blade includes a first contact portion formed at the front of the end of the blade in a direction of travel so that the first contact portion protrudes downward and a second contact portion provided at the rear of the first contact portion in the direction of travel so that the second contact portion is disposed in a longitudinal direction of the blade to support the first contact portion so that the first contact portion does not fall into valleys of a rugged floor.

In accordance with a further aspect, an autonomous cleaning device includes a main body having an opening, a brush unit rotatably provided in the opening of the main body, and a blade assembly to guide movement of dust swept up by the brush unit, wherein the blade assembly includes a blade having a first part fixed to the main body and a second part extended from the first part toward a floor, a fixing member disposed above the blade to push at least a portion of the second part of the blade so that an end of the second part of the blade remains in tight contact with the floor, and a support member provided at a rear of the blade in a travel direction of the main body to prevent the second part of the blade from being bent in a direction opposite to the travel direction of the main body.

The fixing member and the support member may restrict movement of the second part of the blade to within a predetermined range.

The blade may further include a plurality of contact portions provided at an end of the second part so that the contact portions contact the floor.

BRIEF DESCRIPTION OF THE DRAWINGS

The patent or application file contains at least one drawing executed in color. Copies of this patent or patent application publication with color drawing(s) will be provided by the Office upon request and payment of the necessary fee. These and/or other aspects will become apparent and more readily appreciated from the following description of the embodiments, taken in conjunction with the accompanying drawings of which.

DETAILED DESCRIPTION

Figure 1:
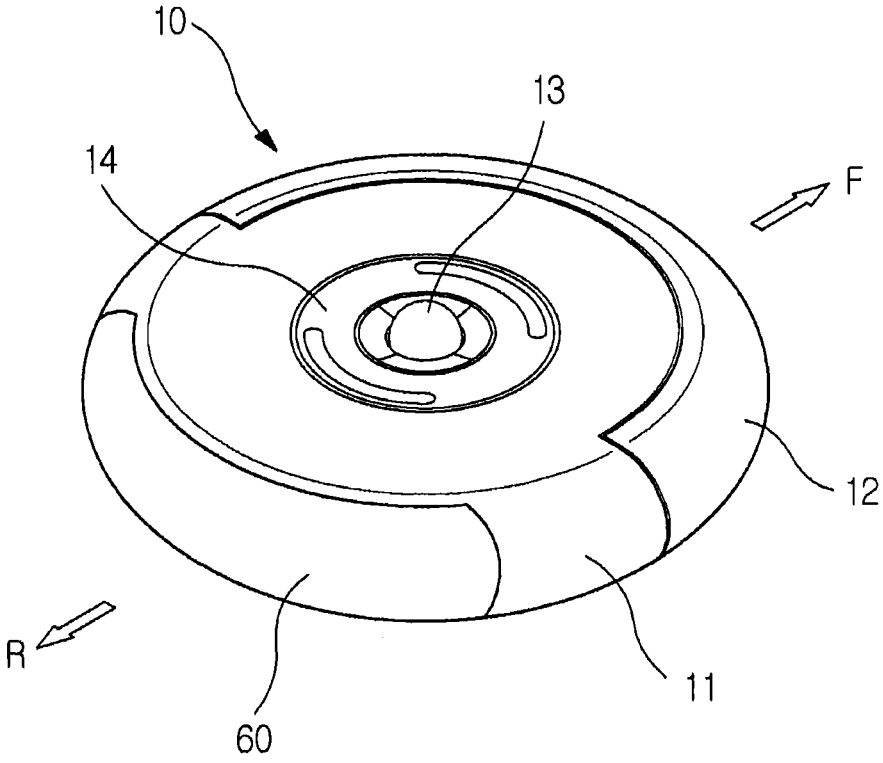
FIG. 1 is a perspective view illustrating an autonomous cleaning device according to an embodiment.

Reference will now be made in detail to the embodiments, examples of which are illustrated in the accompanying drawings, wherein like reference numerals refer to like elements throughout.

Figure 2:
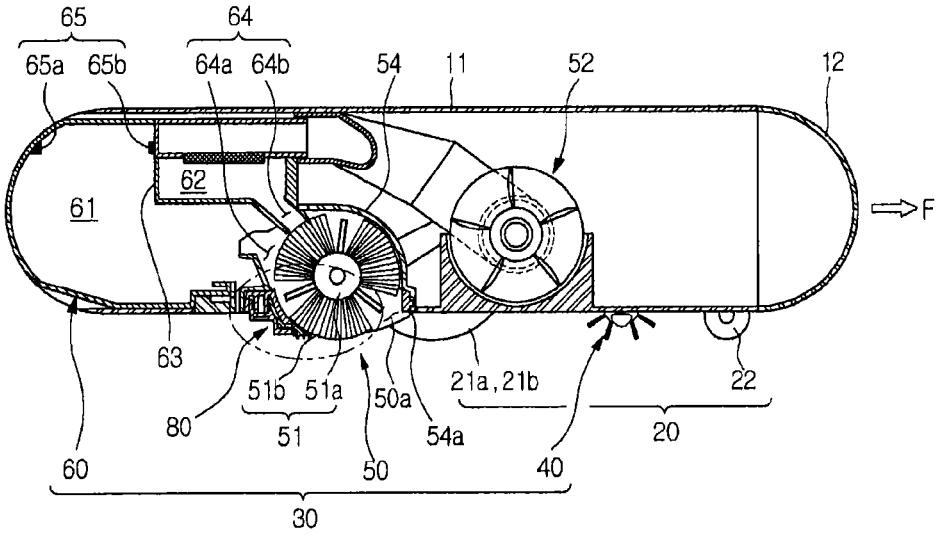
FIG. 2 is a sectional view illustrating the autonomous cleaning device according to the embodiment.
Figure 3:
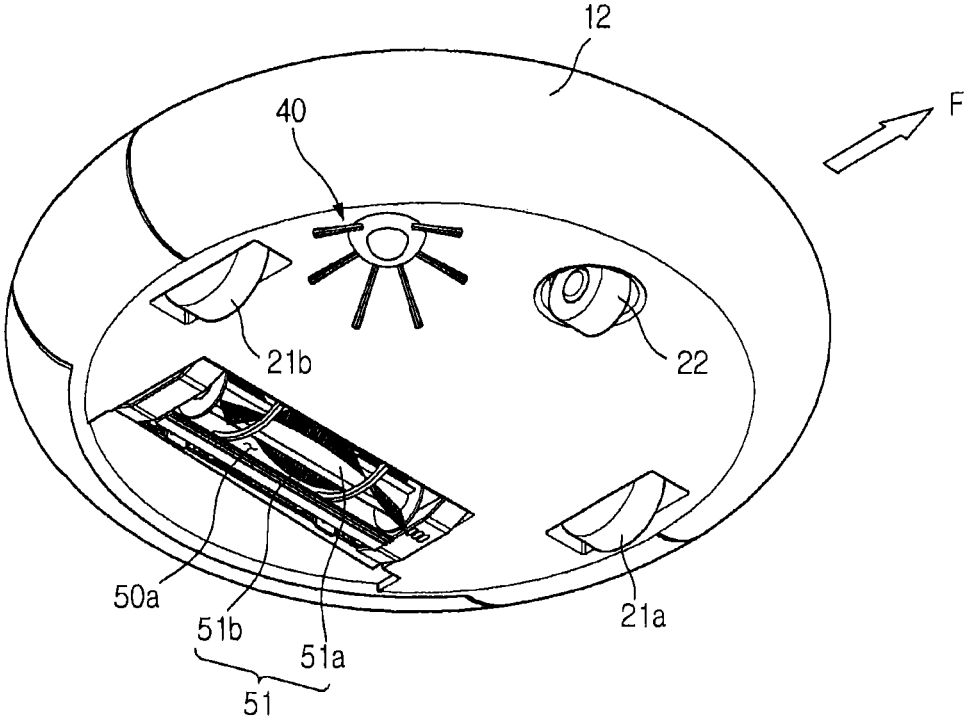
FIG. 3 is a bottom perspective view illustrating the autonomous cleaning device according to the embodiment.

FIG. 1 is a perspective view illustrating an autonomous cleaning device according to an embodiment, FIG. 2 is a sectional view illustrating the autonomous cleaning device according to the embodiment, and FIG. 3 is a bottom perspective view illustrating the autonomous cleaning device according to the embodiment.

As shown in FIGS. 1 to 3, an autonomous cleaning device 10 may include a main body 11, a drive unit 20, a cleaning unit 30 and a controller (not shown).

The main body 11 may be configured in various forms. For example, the main body 11 may be configured in a circular form. The circular main body 11 has a uniform radius of rotation, and therefore, the main body 11 may avoid contact with surrounding obstacles and may easily change course. Also, during travel, the main body 11 may be prevented from being caught by surrounding obstacles.

Various components, for example such as the drive unit 20, the cleaning unit 30, various sensors 12 and 13, a display unit 14, and the controller (not show), to perform cleaning may be provided at the main body 11.

The drive unit 20 may enable the main body 11 to travel about an area to be cleaned. The drive unit 20 may include left and right drive wheels 21*a* and 21*b* and a caster 22. Power from a motor (not shown) may be supplied to the left and right drive wheels 21*a* and 21*b*. Also, the left and right drive wheels 21*a* and 21*b* are mounted at the middle region of the bottom of the main body 11 and the caster 22 may be mounted at the front region of the bottom of the main body 11 so that the main body maintains a stable posture.

Meanwhile, the left and right drive wheels 21*a* and 21*b* and the caster 22 may constitute a single assembly, which may be detachably mounted to the main body 11.

The cleaning unit 30 may remove dust from a floor on which the main body 11 is positioned and surroundings thereof. The cleaning unit 30 may include a side brush 40, a brush drum unit 50 and a dust box 60.

The side brush 40 may be rotatably mounted at one side of the edge of the bottom of the main body 11. The side brush 40 may deviate from the middle region of the main body with an inclination to the front F of the main body 11.

The side brush 40 may move dust collected around the main body 11 to a floor where the main body 11 is positioned. The side brush 40 may extend a cleaning range to an area around a floor where the main body 11 is positioned. In particular, the side brush 40 may remove dust collected from a corner, which is a boundary between a floor and walls.

The brush drum unit 50 may be mounted at a position deviating from the middle region of the bottom of the main body 11. The brush drum unit 50 may deviate from the left and right drive wheels 21*a* and 21*b* mounted at the middle region of the bottom of the main body 11 toward the rear R of the main body 11.

The brush drum unit 50 may remove dust collected on a floor where the main body 11 is positioned. The brush drum unit 50 may include a dust introduction channel 50*a* forming a dust introduction route. Also, the brush drum unit 50 may include a brush unit 51 provided in the dust introduction channel 50*a* to sweep dust off of the floor.

The brush unit 51 may include a roller 51*a* and a brush 51*b* formed at the outer circumference of the roller 51*a*. Power from a motor 56 (see FIG. 4) may be supplied to the roller 51*a*. Through rotation of the roller 51*a*, the brush 51*b* may sweep up dust collected on the floor. The roller 51*a* may be formed of a rigid body, to which, however, the roller 51*a* is not limited. The brush 51*b* may be formed of various materials exhibiting high elasticity.

The brush unit 51 may be driven at uniform speed to maintain uniform cleaning performance. When a floor surface that is not smooth, for example, such as a carpet, is cleaned, the rotational speed of the crush unit 51 may be lower than the rotational speed of the brush unit 51 when a smooth floor surface is cleaned. At this time, additional current may be supplied to ensure that the brush unit 51 maintain a uniform rotational speed.

The dust box 60 may be mounted at the rear R of the main body 11. An introduction port 64 of the dust box 60 may communicate with the dust introduction channel 50*a* of the brush drum unit 50. Consequently, dust swept by the brush unit 51 may be stored in the dust box 60 via the dust introduction channel 50*a*.

The dust box 60 may be divided into a large dust box 61 and a small dust box 62 by a partition 63. Correspondingly, the introduction port 64 may be divided into a first introduction port 64*a* provided at an inlet of the large dust box 61 and a second introduction port 64*b* provided at an inlet of the small dust box 62.

The brush unit 51 may sweep relatively large dust particles into the large dust box 61. A blowing unit 52 may suction relatively small airborne dust, such as hair, into the small dust box 62. In particular, a brush cleaning member 59 may be provided at a position adjacent to the second introduction port 64*b* to separate hair from the brush unit 51. The hair separated from the brush unit 51 by the brush cleaning member 59 may be stored in the small dust box 62 by suction force of the blowing unit 52.

Also, a dust amount detection unit 65 may be provided in the dust box 60 to detect whether the dust box 60 is filled with dust. The dust amount detection unit 65 may include a light emitting part 65*a* to emit a beam and a light receiving part 65*b* to receive the beam. When an amount of light received by the light receiving part 65*b* is equal to or less than a predetermined value, it may be determined that the dust box 60 is filled with dust.

Meanwhile, the brush drum unit 50, the brush unit 51 and the dust box 60 may constitute a single assembly, which may be detachably mounted to the main body 11.

The sensors 12 and 13 may include a proximity sensor 12 and/or an optical sensor 13. For example, when the autonomous cleaning device 10 travels in an arbitrary direction without a predetermined route, i.e. in a cleaning system not employing a map, the autonomous cleaning device 10 may travels about an area to be cleaned using the proximity sensor 12. On the other hand, when the autonomous cleaning device 10 travels along a predetermined route, i.e. in a cleaning system having a map, the optical sensor 13 may be provided to receive position information of the autonomous cleaning device 10 and create a map. The optical sensor 13 corresponds to an embodiment of a location system. Other various methods may be provided.

The display unit 14 may display various states of the autonomous cleaning device 10. For example, the display unit 14 may display a battery charge state, whether the dust box 60 is filled with dust, and a cleaning mode or a resting mode of the autonomous cleaning device 10.

The controller (not shown) may control the drive unit 20 and the cleaning unit 30 to efficiently perform a cleaning task. The controller may receive signals from the sensors 12 and 13 to avoid an obstacle or change travel modes.

Also, the controller may receive a signal from the dust amount detection unit 65. Upon determining that the dust box 60 is filled with dust, the controller may dock with a maintenance station (not shown) to automatically remove dust from the dust box 60 or may sound an alarm to notify a user.

Also, the controller may receive a signal from a dust introduction detection unit 70 to distinguish between an area from which dust is introduced and an area from which dust is not introduced. For example, an area may be traveled over repeatedly, a travel speed may be reduced or rotational force of the brush unit 51 or the suction force of the blowing unit 52 may be increased to improve cleaning efficiency at an area from which dust is introduced. On the other hand, a cleaning sequence may be delayed or the number of times of travel may be reduced at an area from which dust is not introduced.

Figure 4:
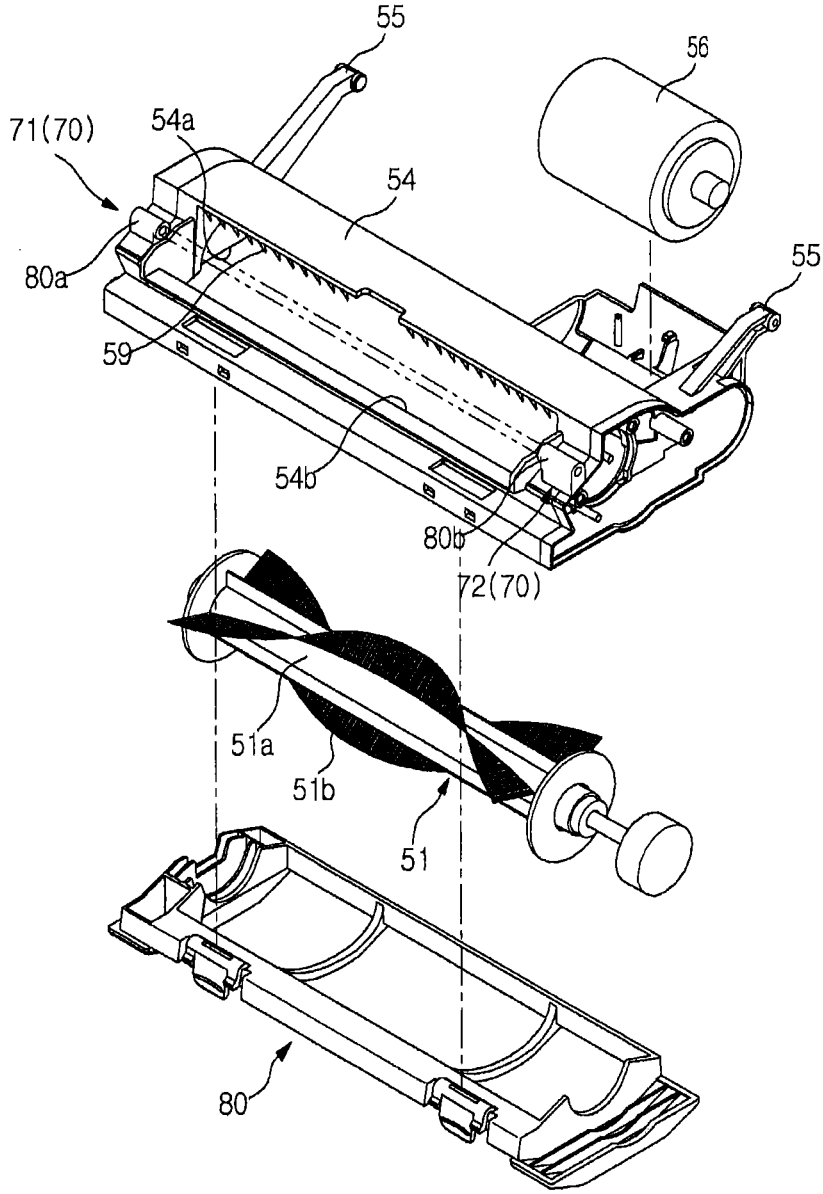
FIG. 4 is an exploded perspective view illustrating a brush drum unit according to an embodiment.
Figure 5:
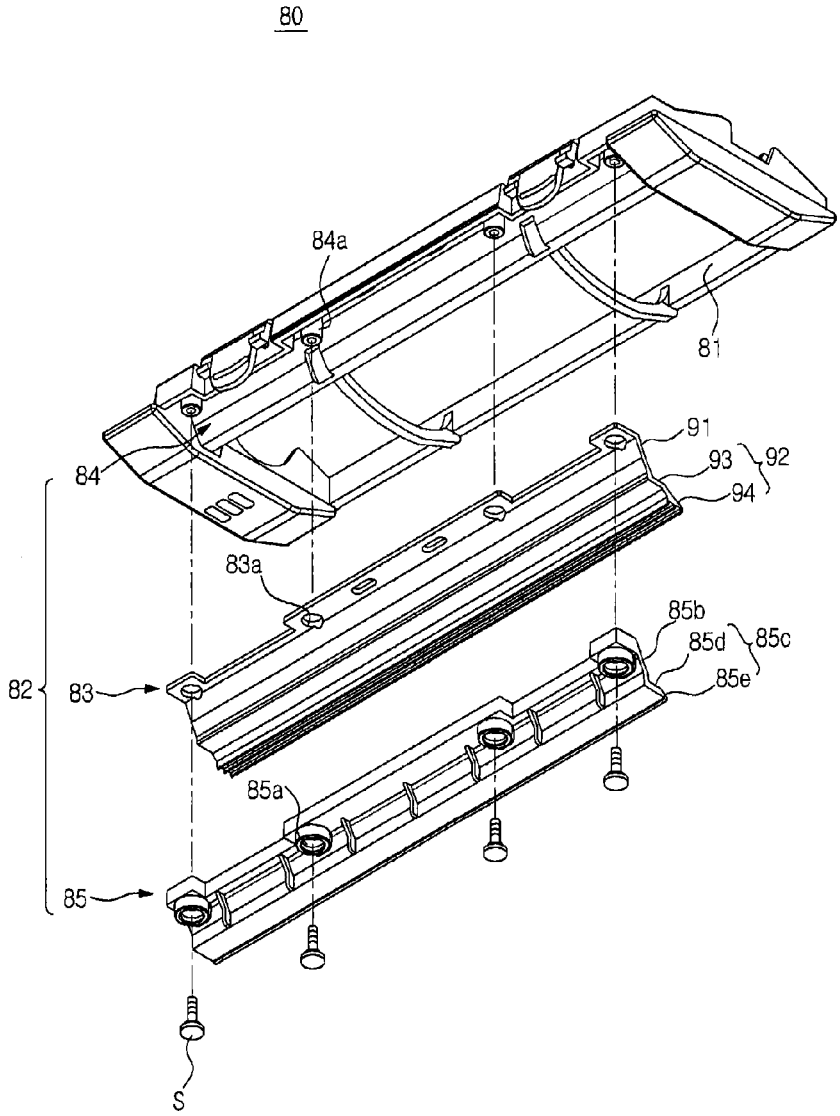
FIG. 5 is an exploded bottom perspective view illustrating a cover unit according to an embodiment.
Figure 6:
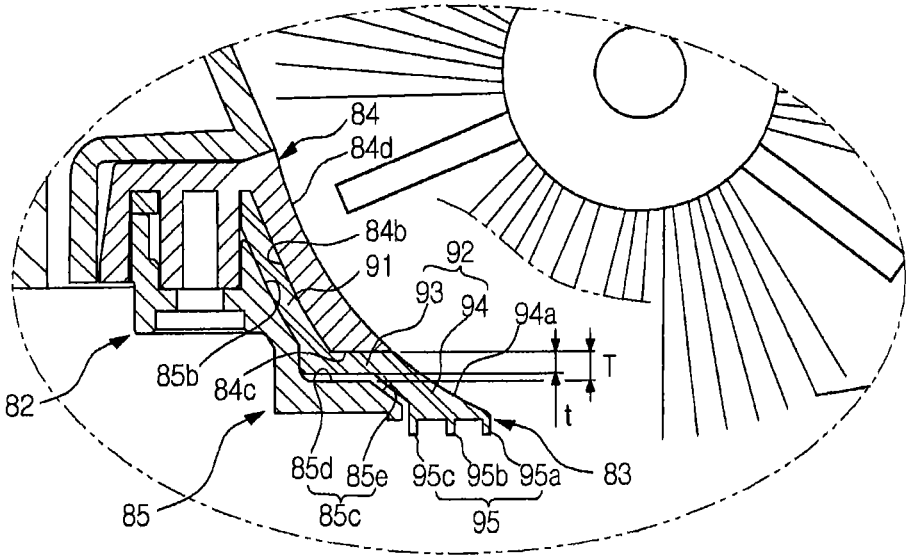
FIG. 6 is an enlarged sectional view illustrating a blade assembly of the cover unit according to the embodiment.

FIG. 4 is an exploded perspective view illustrating a brush drum unit according to an embodiment, FIG. 5 is an exploded bottom perspective view illustrating a cover unit according to an embodiment, and FIG. 6 is an enlarged sectional view illustrating a blade assembly of the cover unit according to the embodiment.

As shown in FIGS. 1 to 6, the brush drum unit 50 may include a housing 54, a motor 56, a brush unit 51, a dust introduction detection unit 70 and a cover unit 80.

The housing 54 may be formed generally in a semi-cylindrical shape. The housing 54 may be provided at the bottom thereof with a first opening 54*a* opened to a floor surface. A second opening 54*b* communicating with the dust box 60 may be formed at the upper side of the first opening 54*a*. The dust introduction channel 50*a* may be a route which extended from the first opening 54*a* to the second opening 54*b*.

The housing 54 may be detachably mounted to the main body 11. In particular, a pivot arm 55 may tilt the housing 54 with respect to the main body 11. Through this structure, the housing 54 may move downward due to gravity when the autonomous cleaning device 10 travels on a smooth floor surface, for example, such as a wooden floor, exhibiting low frictional contact force with the brush unit 51, and the housing 54 may tilt upward when the autonomous cleaning device 10 travels on a floor surface, for example, such as a carpet, exhibiting high frictional contact force with the brush unit 51. At this time, the brush unit 51 may be tilted upward, thereby reducing load applied to the motor 56.

The motor 56 may be mounted at the housing 54. The motor 56 may supply power to the brush unit 51. For example, the motor 56 and the brush unit 51 may be connected to each other via a series of gears (not shown).

The brush unit 51 may be rotatably mounted to the housing 54. The brush unit 51 may be rotated by power supplied from the motor 56.

The dust introduction detection unit 70 may determine whether or not dust is introduced into the dust introduction channel 50*a* of the housing 54 or an introduction amount of dust. The controller may determine whether or not the autonomous cleaning device 10 is properly performing cleaning and which area is to be further cleaned through the operation of the dust introduction detection unit 70.

The dust introduction detection unit 70 may include a light emitting part 71 and a light receiving part 72. The light emitting part 71 and the light receiving part 72 may be mounted at positions at opposite adjacent sides of the second opening 54*b* of the housing 54. In another embodiment, the light emitting part 71 and the light receiving part 72 may be mounted at positions at opposite adjacent sides of the introduction port 64 of the dust box 60 connected to the second opening 54*b* of the housing 54.

The cover unit 80 may be detachably mounted at the first opening 54*a* of the housing 54. A user may open the cover unit 80 to mount/separate the brush unit 51 to/from the housing 54.

The cover unit 80 may include a cover 81 and a blade assembly 82.

The cover 81 may have a size corresponding to the first opening 54*a* of the housing 54. The cover 81 may be formed in a hollow shape, i.e. a shape having an outer edge and a hollow interior. In another embodiment, the cover 81 may be formed in a lattice shape. In this case, the lattice of the cover 81 may have a size appropriate to smoothly introduce dust.

The blade assembly 82 may be formed at one side of the cover 81. In particular, the blade assembly 82 is mounted at the rear of the brush unit 51 to serve as a kind of dustpan when the brush unit 51 sweeps dust.

The blade assembly 82 may include a blade 83, a fixing member 84 and a support member 85. The fixing member 84 and the support member 85 may be mounted so that the blade 83 exhibits proper rigidity and flexibility. As a result, a function of the blade 83 is improved to increase cleaning efficiency.

The fixing member 84 may be integrally formed at one side of the cover 81. The blade 83 may be stacked below the fixing member 84, and the support member 85 may be stacked below the blade 83. The fixing member 84 is provided with a protrusion 84*a* having a screw groove. The blade 83 and the support member 85 have holes 83*a* and 85*a* through which the protrusion 84*a* of the fixing member 84 is inserted. The protrusion 84*a* of the fixing member 84 is sequentially inserted through the hole 83*a* of the blade 83 and the hole 85*a* of the support member 85, and then a screw S is coupled to the protrusion 84*a* of the fixing member 84, thereby completing the blade assembly 82.

The blade 83 may be formed of a flexible material, for example, such as rubber, and may be mounted so as to be inclined downward toward a floor. At this time, the end of the blade 83 may come into tight contact with the floor.

The blade 83 may include a first part 91 and a second part 92 extended from the first part 91 toward the floor.

The first part 91 of the blade 83 is inclined downward. The first part 91 of the blade 83 is tightly fixed by a first fixing part 84*b* of the fixing member 84 and a first support part 85*b* of the support member 85. That is, the first part 91 of the blade 83 is inserted and supported between the first fixing part 84*b* of the fixing member 84 and the first support part 85*b* of the support member 85, and therefore, the first part 91 of the blade 83 is prevented from moving.

The second part 92 of the blade 83 may include a moving portion 93 and a tight contact portion 94. As shown in the drawings, the moving portion 93 may be disposed horizontally, and the tight contact portion 94 may be inclined downward. In another embodiment, the moving portion 93 may have a predetermined inclination.

A second fixing part 84*c* of the fixing member 84 is provided adjacent to the upper side of the second part 92 of the blade 83. That is, the second fixing part 84*c* of the fixing member 84 is provided adjacent to the upper side of the moving portion 93 of the second part 92 of the blade 83. The second fixing part 84*c* of the fixing member 84 pushes the moving portion 93 of the blade 83 downward so that the end of the tight contact portion 94 comes into tight contact with the floor. Also, upward movement of the moving portion 93 of the blade 83 is restricted, thereby preventing the end of the tight contact portion 94 from moving off of the floor.

A second support part 85*c* of the support member 85 is provided adjacent to the lower side of the second part 92 of the blade 83. That is, the second support part 85*c* of the support member 85 may include a first movement restriction portion 85*d* and a second movement restriction portion 85*e* corresponding to the moving portion 93 and the tight contact portion 94 of the second part 92 of the blade 83. The first movement restriction portion 85*d* of the support member 85 is provided adjacent to the moving portion 93 of the blade 83, and the second movement restriction portion 85*e* of the support member 85 is also provided adjacent to the tight contact portion 94 of the blade 83.

In other words, the moving portion 93 of the blade 83 is provided between the second fixing part 84*c* of the fixing member 84 and the second support part 85*c* of the support member 85. The thickness t of the moving portion 93 of the blade 83 is less than the distance T between the second fixing part 84*c* and the second support part 85*c*. When the moving portion 93 of the blade 83 completely contacts the second fixing part 84*c* of the fixing member 84, the second support part 85*c* of the support member 85 may be spaced apart from at least a portion of the moving portion 93 of the blade 83 by a predetermined distance. In particular, the second support part 85*c* is spaced apart from a boundary between the moving portion 93 and the tight contact portion 94, i.e. the end of the moving portion 93, by a predetermined distance T-t.

The second part 92 of the blade 83 may move between the second fixing part 84*c* of the fixing member 84 and the second support part 85*c* of the support member 85 within a predetermined range. In particular, the second support part 85*c* of the support member 85 prevents the second part 92 of the blade 83 from being bent in the direction opposite to the travel direction of the main body 11, thereby securing operational reliability of the blade 83.

A plurality of contact portions 95 may be formed at the end of the second part 92 of the blade 83. The contact portions 95 may be spaced apart from each other and may in contact with the floor. Consequently, the end of the blade 83 comes into surface contact with the floor through the contact portions 95. Here, each of the contact portions 95 may be formed in a quadrangular shape in section. In another embodiment, a first contact portion 95*a* (see FIG. 7) may be formed in a wedge shape to increase contact area between the first contact portion and the floor.

Meanwhile, guides 84*d* and 94*a* of the blade assembly 82 may be formed to coincide with the rotational arc of the brush unit 51. That is, the first guides 84*d* of the fixing member 84 and the second guides 94*a* of the blade 83 may be smoothly connected to each other, and the first guides 84*d* and the second guides 94*a* may coincide with the rotational arc of the brush unit 51. As a result, the guides 84*d* and 94*a* of the blade assembly 82 may enable the brush unit 51 to easily suction dust.

In another embodiment, the guides 84*d* and 94*a* of the blade assembly 82 may not coincide with the rotational arc of the brush unit 51 but may be formed in various shapes, for example, such as a straight line or a curved line.

Hereinafter, the operation of the autonomous cleaning device according to the embodiment will be described with reference to the accompanying drawings.

Figure 7:
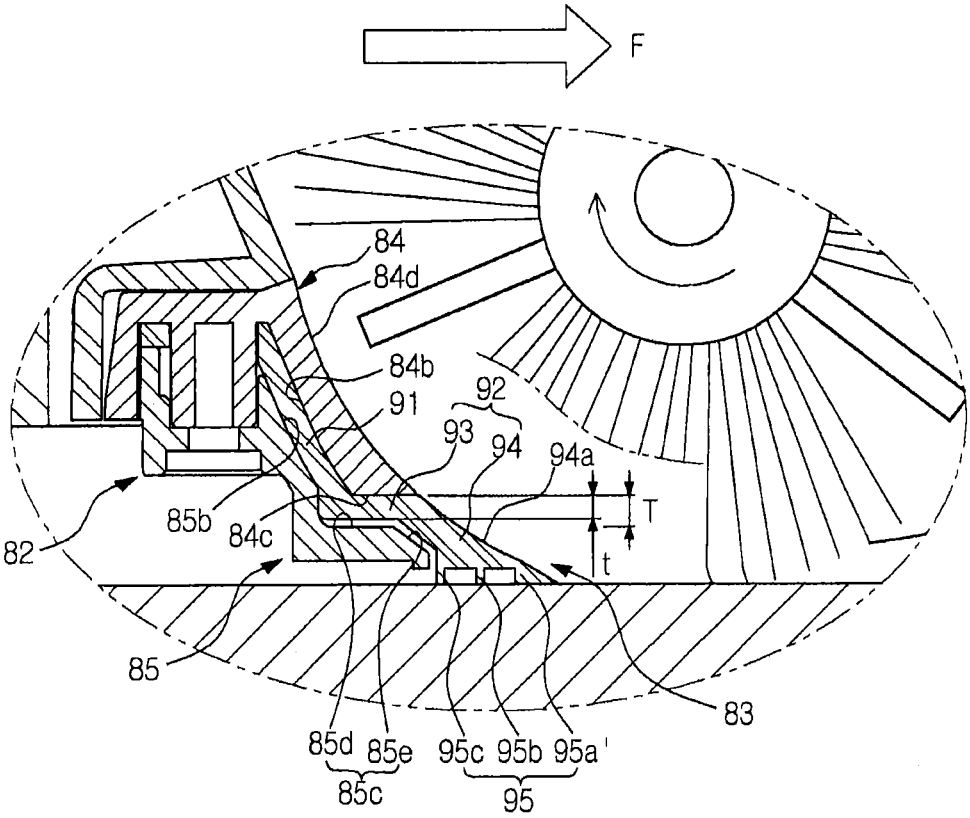
FIG. 7 is a view illustrating the operation of the blade assembly when the autonomous cleaning device according to the embodiment travels on a smooth floor.
Figure 8:
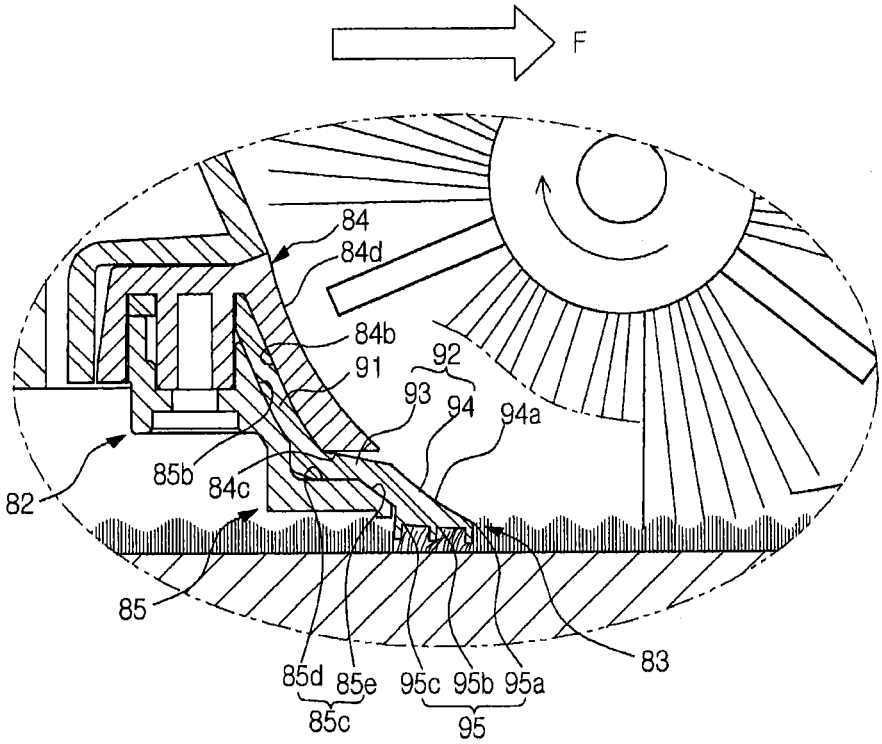
FIG. 8 is a view illustrating the operation of the blade assembly when the autonomous cleaning device according to the embodiment travels on a floor, such as a carpet, exhibiting high frictional contact force.
Figure 9:
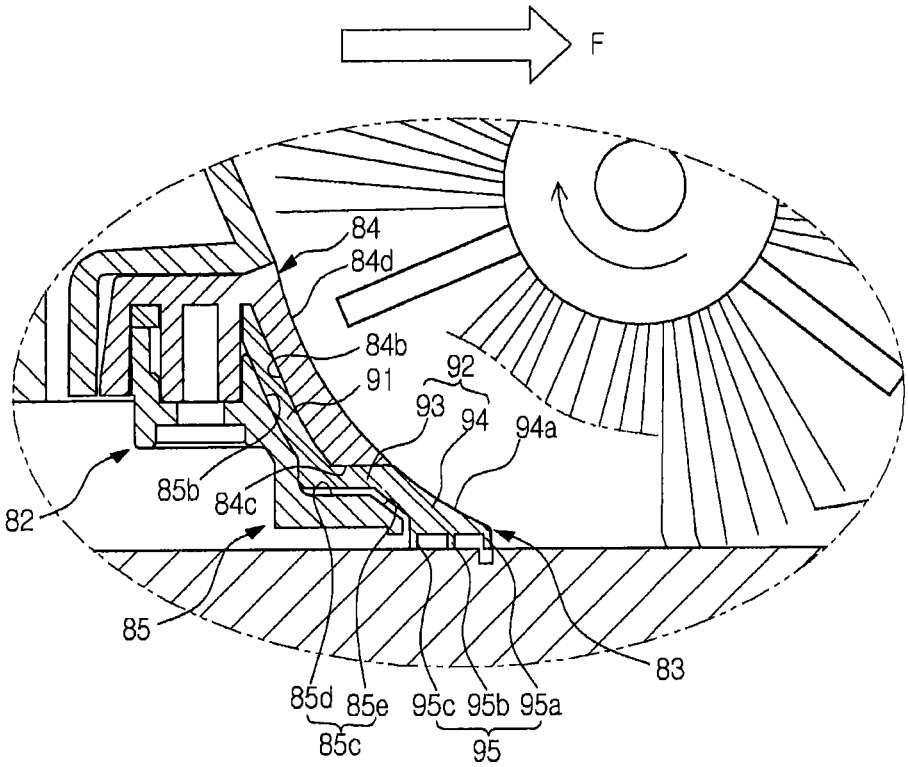
FIG. 9 is a view illustrating the operation of the blade assembly when the autonomous cleaning device according to the embodiment travels on a floor having a crevice.

FIG. 7 is a view illustrating the operation of the blade assembly when the autonomous cleaning device according to the embodiment travels on a smooth floor, FIG. 8 is a view illustrating the operation of the blade assembly when the autonomous cleaning device according to the embodiment travels on a floor, for example, such as a carpet, exhibiting high frictional contact force, and FIG. 9 is a view illustrating the operation of the blade assembly when the autonomous cleaning device according to the embodiment travels on a floor having a crevice.

As shown in FIG. 7, the autonomous cleaning device 10 may travel on a smooth floor. In this case, frictional force between the blade assembly 82 and the floor may be relatively small. At this time, the second part 92 of the blade 83 is lowered due to gravity. In particular, the moving portion 93 of the second part 92 is pushed downward by the second fixing part 84*c* of the fixing member 84. Consequently, the autonomous cleaning device 10 may travel in a state in which the contact portions 95 of the blade 83 are in tight contact with the floor. As a result, the end of the blade 83 is prevented from moving off of the floor, and therefore, the brush unit 51 may more efficiently sweep dust into the dust box 60.

Also, the moving portion 93 of the second part 92 of the blade 83 may move between the second fixing part 84*c* of the fixing member 84 and the second support part 85*c* of the support member 85 within a predetermined range, and therefore, the second part 92 of the blade 83 may exhibit a certain degree of flexibility. In addition, no member is mounted at the upper side of the tight contact portion 94 of the second part 92 of the blade 83. The tight contact portion 94 of the second part 92 of the blade 83 may exhibit flexibility due to the flexible material property thereof.

Also, as shown in FIG. 8, the autonomous cleaning device 10 may travel on a coarse floor, for example such as a carpet. In this case, frictional force between the blade assembly 82 and the floor may be relatively large. As a result, force is applied to the second part 92 of the blade in the direction opposite to the direction of travel. At this time, the second support part 85*c* of the support member 85 may prevent the second part 92 of the blade 83 from being bent in the direction opposite to the direction of travel. Consequently, the shape of the blade 83 is maintained and the function of the blade 83 is also maintained. In this way, the support member 85 restricts the movement of the blade 83 to within a predetermined range, and therefore, the blade 83 may perform cleaning in a state in which the rigidity of the blade 83 is maintained to some extent.

Also, as shown in FIG. 9, the autonomous cleaning device 10 may travel over a floor having a crevice. In this case, the horizontal state of the contact portions 95 formed at the end of the blade 83 may be maintained when the blade 83 passes over the crevice formed in the floor. For example, when a first contact portion 95*a* disposed at the front end passes over the crevice, a second contact portion 95*b* and a third contact portion 95*c* disposed at the rear end come into tight contact with the floor with the result that the first contact portion 95*a* does not fall into the crevice. That is, since the second contact portion 95*b* and the third contact portion 95*c* are supported by the floor, the horizontal state of the first contact portion 95*a*, the second contact portion 95*b* and the third contact portion 95*c* is maintained, and therefore, the first contact portion 95*a* does not fall into the crevice. The same conditions may be applied when the second contact portion 95*b* or the third contact portion 95*c* passes over the crevice. Consequently, any one of the contact portions 95 does not fall into the crevice, and therefore, abnormal noise or abnormal operation, which may be caused when the end of the blade 83 falls into the crevice or is caught by the crevice during travel, may be prevented. The cleaning function and the travelling function of the autonomous cleaning device 10 may be secured based on this structure.

Figure 10A:
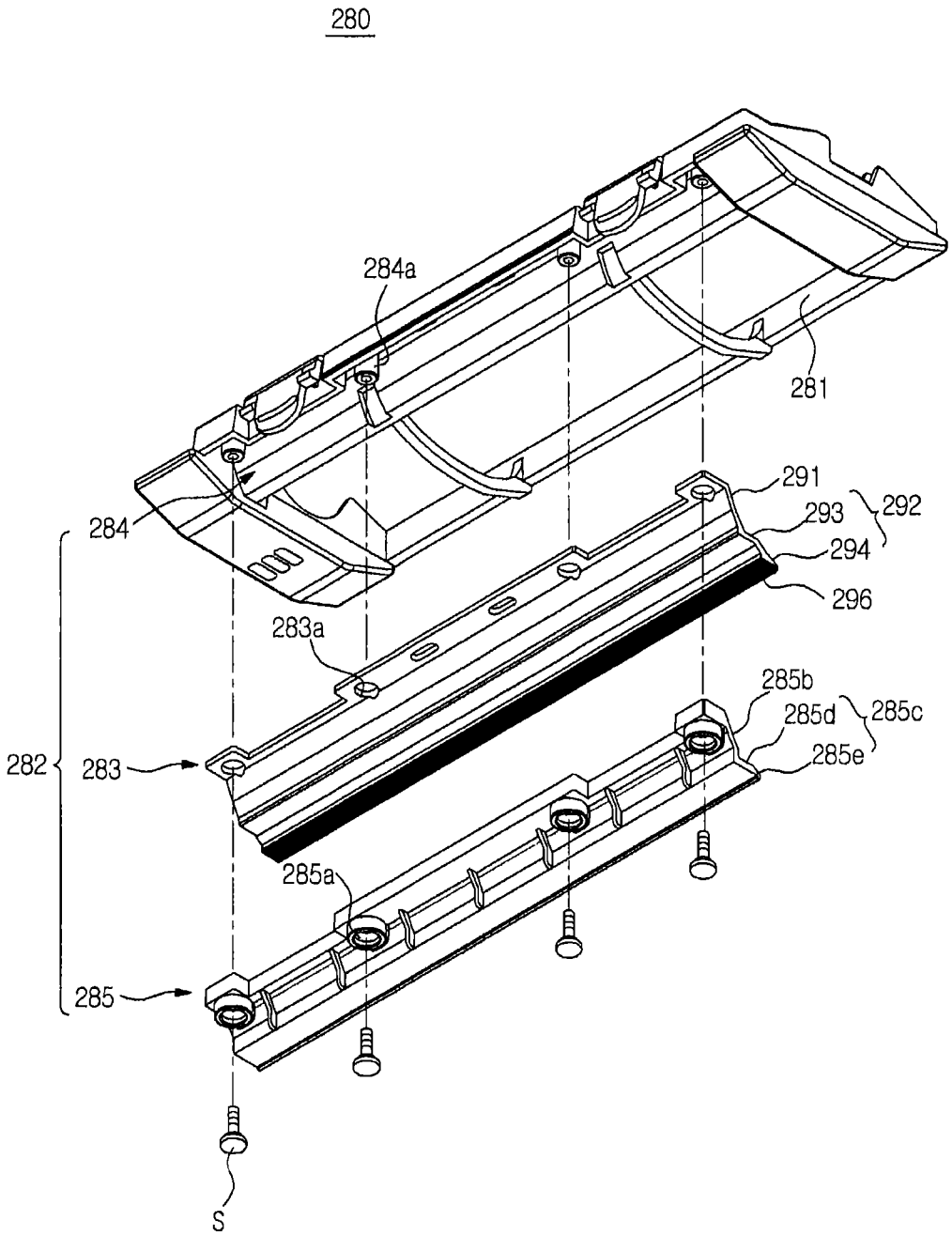
FIG. 10A is a bottom exploded view illustrating a cover unit according to another embodiment.
Figure 10B:
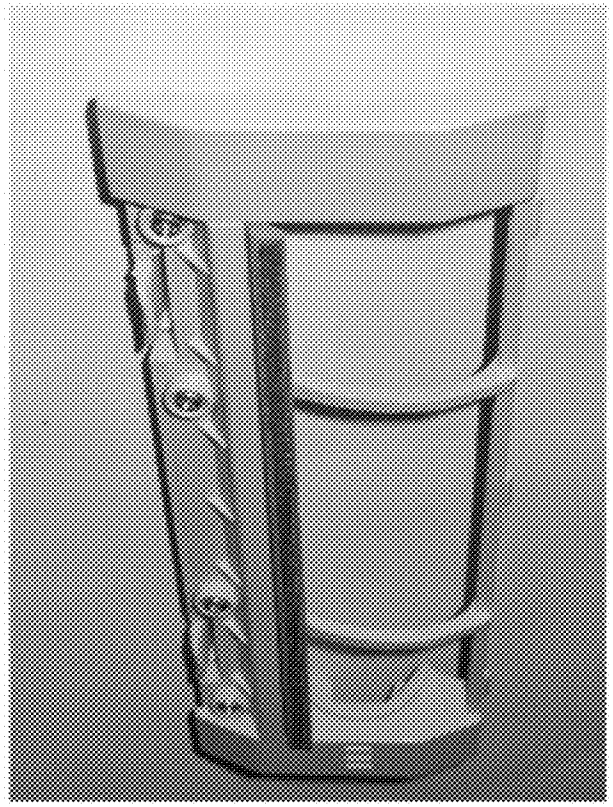
FIG. 10B is a photograph illustrating the cover unit according to the embodiment.

FIG. 10A is a bottom exploded view illustrating a cover unit according to another embodiment, and FIG. 10B is a photograph illustrating the cover unit according to the embodiment.

Figure 11:
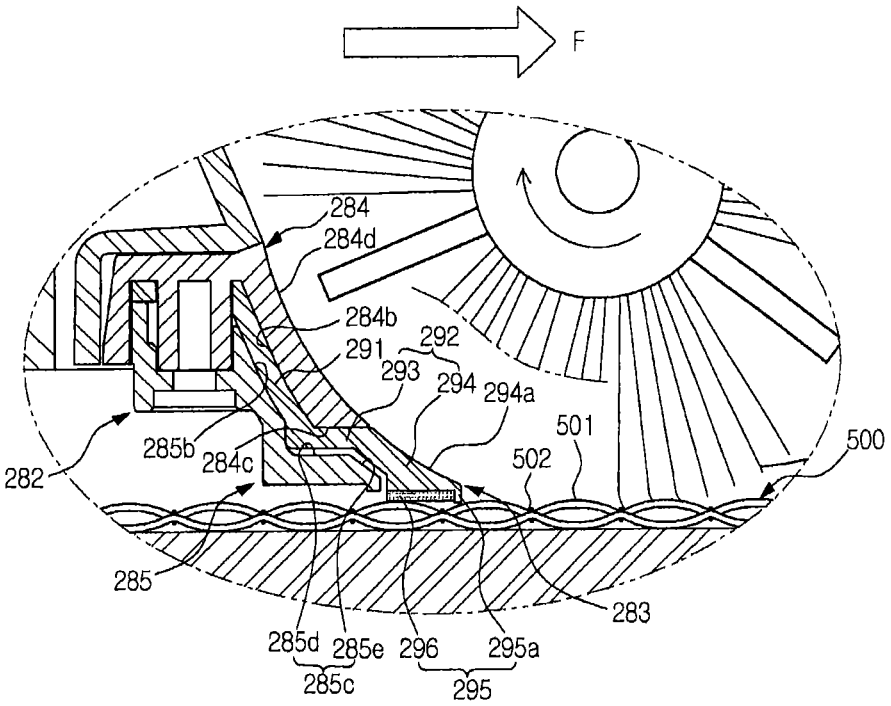
FIGS. 11 and 12 are views illustrating the operation of a blade assembly when the autonomous cleaning device according to the embodiment travels on a tatami (straw-mat) floor.
Figure 12:
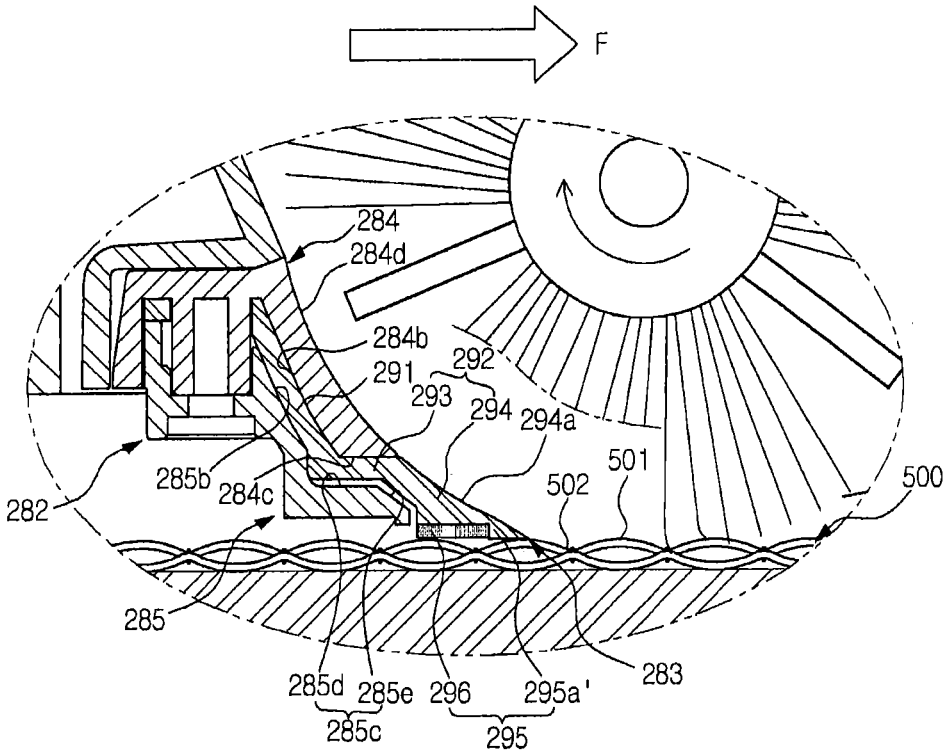

FIGS. 11 and 12 are views illustrating the operation of a blade assembly when the autonomous cleaning device according to the embodiment travels on a tatami (straw-mat) floor.

As shown in FIGS. 10A to 12, a blade assembly 282 may include a blade 283, a fixing member 284 and a support member 285. The fixing member 284 and the support member 285 may be mounted so that the blade 283 exhibits proper rigidity and flexibility. Hereinafter, the blade assembly 282 will be described based on differences between the blade assembly 282 and the previously described blade assembly 82.

The blade 283 may includes a first part 291 constituting the upper part thereof and a second part 292 extended from the first part 291 toward a floor side.

The first part 291 is tightly fixed by a first fixing part 284*b* and a first support part 285*b*.

The second part 292 may include a moving portion 293 and a tight contact portion 294. The second part 292 is moved between a second fixing part 284*c* and a second support part 285*c*. However, the movement of the second part 292 is restricted within a predetermined range, as previously described.

The second part 292 of the blade 283 is provided at the front thereof in a direction of travel with a first contact portion 295*a* protruding downward. The first contact portion 295*a* may be formed in a quadrangular shape in section.

In another embodiment, a first contact portion 295*a*' (see FIG. 12) may be formed in a wedge shape in section to increase contact area with the first contact portion 295*a*' and a floor. In addition, guides 284*d* and 294*a* of the blade assembly 82 are formed to coincide with the rotational arc of the brush unit 51 and the top of the first contact portion 295*a*' is formed to coincide with the rotational arc of the brush unit 51. As a result, suction of dust through the brush unit 51 is easily achieved.

The second part 292 is provided at the rear end of the first contact portion 295*a* thereof in a direction of travel with a horizontality maintaining portion 296.

The first contact portion 295*a* guides dust swept up by the brush unit 51 to the dust box 60 in a state in which the first contact portion 295*a* is in contact with a floor. When a rugged tatami floor 500 is cleaned as shown in the drawings, however, the first contact portion 295*a* falls into valleys 502 of the floor 500 and collides with ridges 501 of the floor 500 during traveling of the autonomous cleaning device 10. As a result, the first contact portion 295*a* may be damaged, the tatami floor 500 may be damaged, and noise may be generated. The horizontality maintaining portion 296 is provided to prevent such damage and noise.

The horizontality maintaining portion 296 is formed to be wider than the width between neighboring ridges 501 of the tatami floor 500. Consequently, the horizontality maintaining portion 296 supports the first contact portion 295*a* so that the first contact portion 295*a* moves horizontally without falling into the valleys 502 of the tatami floor 500. For this reason, the horizontality maintaining portion 296 is formed at the end of the second part 292 with a width greater than the width between neighboring ridges 501 of the tatami floor 500. In the drawings, however, the horizontality maintaining portion 296 is shown as entirely covering the end of the second part 292 from the rear end of the first contact portion 295*a*.

The first contact portion 295*a* contacts the floor. Consequently, the distance from the bottom of the first contact portion 295*a* to the floor is equal to or less than the distance from the bottom of the horizontality maintaining portion 296 to the floor. In the drawings, the distance from the bottom of the first contact portion 295*a* to the floor is shown as being equal to or less than the distance from the bottom of the horizontality maintaining portion 296 to the floor.

The horizontality maintaining portion 296 may be formed of a flexible material, such as a brush, rubber, sponge or fiber, to minimize damage to the tatami floor 500. Consequently, the first contact portion 295*a* as well as the second part 292 comes into tight contact with the floor by the horizontality maintaining portion 296.

A photograph of a product in which the horizontality maintaining portion 296 is formed of a brush is shown in FIG. 10B. In the photograph, the brush is attached to the end of the blade.

Meanwhile, the horizontality maintaining portion 296 may be formed of a material exhibiting frictional force lower than that of the first contact portion 295*a* since the horizontality maintaining portion 296 is provided to minimize damage to the tatami floor 500.

The horizontality maintaining portion 296 may serve as an auxiliary brush to collect residual dust which has not been swept up by the brush unit 51 so that the residual dust is easily swept up by the brush unit 51.

The horizontality maintaining portion 296 may not tightly contact the first contact portion 295*a*; however, the distance between the horizontality maintaining portion 296 and the first contact portion 295*a* is formed to be narrower than the width of each ridge 501 of the tatami floor 500. If the distance between the horizontality maintaining portion 296 and the first contact portion 295*a* is greater than the width of each ridge 501 of the tatami floor 500, the ridge 501 is inserted between the horizontality maintaining portion 296 and the first contact portion 295*a* with the result that noise may be generated, and the tatami floor 500 may be damaged.

Figure 13:
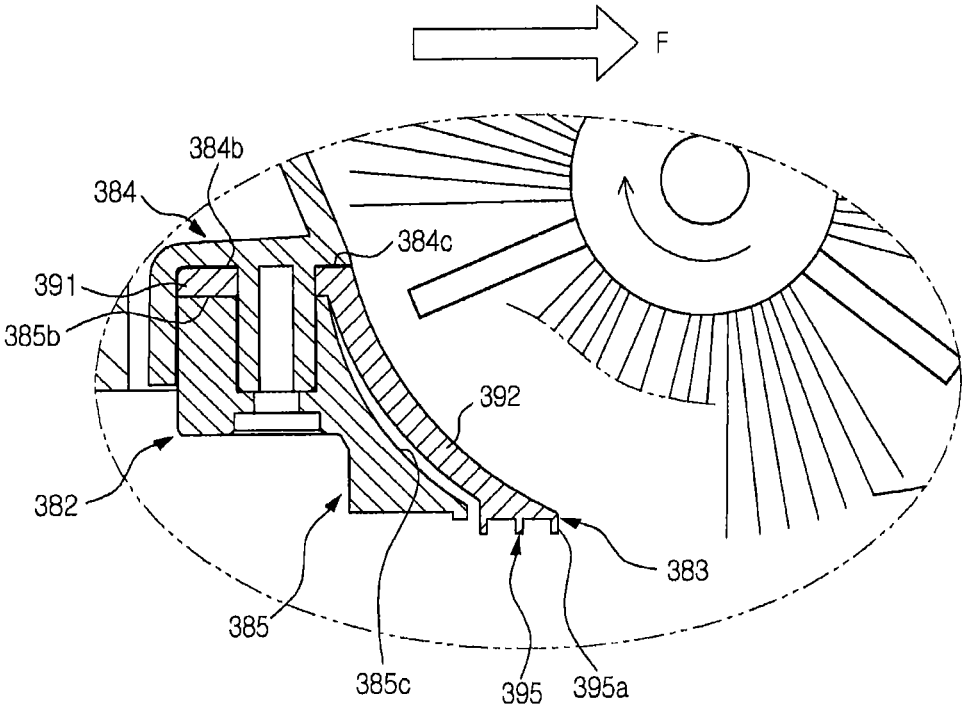
FIGS. 13 and 14 are sectional views illustrating a blade assembly according to another embodiment.
Figure 14:
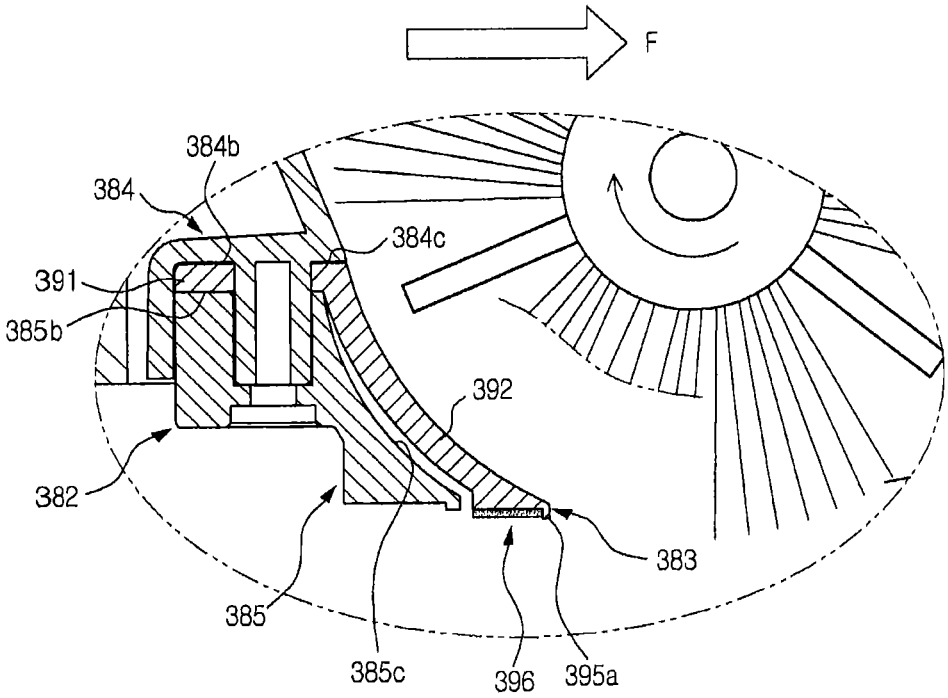

FIGS. 13 and 14 are sectional views illustrating a blade assembly according to another embodiment.

As shown in FIGS. 13 and 14, a blade assembly 382 may include a blade 383, a fixing member 384 and a support member 385. The fixing member 384 and the support member 385 may be mounted so that the blade 383 exhibits proper rigidity and flexibility. Hereinafter, the blade assembly 382 will be described based on differences between the blade assembly 382 and the previously described blade assembly 82.

A first part 391 of the blade 383 is mounted in the horizontal direction and is tightly fixed by a first fixing part 384*b* of the fixing member 384 and a first support part 385*b* of the support member 385. That is, the first part 391 is inserted between the first fixing part 384*b* and the first support part 385*b* so that the first part 391 is pushed upward and downward, and therefore, the first part 391 is prevented from moving.

A second part 392 of the blade 383 is inclined. A second fixing part 384*c* of the fixing member 384 is provided adjacent to the upper end of the second part 392 of the blade 383. The second fixing part 384*c* pushes the second part 392 of the blade 383 downward so that the lower end of the second part 392 comes into tight contact with a floor. Also, upward movement of the second part 392 of the blade 383 is restricted, thereby preventing the lower end of the second part 392 from moving off of the floor.

A second support part 385*c* of the support member 385 is provided adjacent to the lower side of the second part 392 of the blade 383. The second support part 385*c* is almost in contact with the upper part of the second part 392 of the blade 383 and is spaced apart from the lower part of the second part 392 of the blade 383 by a predetermined distance. That is, the distance between the second part 392 of the blade 383 and the second support part 385*c* increases from the upper side to the lower side of the part 392 of the blade 383 so that the second part 392 of the blade 383 exhibits proper flexibility and rigidity.

The second part 392 of the blade 383 may be moved by the second fixing part 384*c* and the second support part 385*c* within a predetermined range. In particular, the second support part 385*c* prevents the second part 392 of the blade 383 from being bent in the direction opposite to the travel direction of the main body 11, thereby securing operational reliability of the blade 383.

Particularly, as shown in FIG. 12, a plurality of contact portions 395 may be formed at the lower end of the second part 392 of the blade 383. As previously described, a front one of the contact portions 395, i.e. a first contact portion 395*a*, may be formed in a quadrangular or wedge shape in section.

As shown in FIG. 13, on the other hand, the second part 392 of the blade 383 is provided at the front thereof in the travel direction of the autonomous cleaning device 10 with a first contact portion 395*a* protruding downward. The first contact portion 395*a* may be formed in a quadrangular or wedge shape in section.

The second part 392 is provided at the rear end of the first contact portion 395*a* thereof in a direction of travel with a horizontality maintaining portion 396. When the autonomous cleaning device 10 cleans a tatami floor 500, the horizontality maintaining portion 396 supports the first contact portion 395*a* so that the first contact portion 395*a* moves horizontally without falling into valleys 502 of the tatami floor 500. Consequently, noise is reduced, and damage to the tatami floor 500 is prevented.

The horizontality maintaining portion 396 is formed to be wider than the width between neighboring ridges 501 of the tatami floor 500 so that the first contact portion 395*a* moves horizontally over the rugged tatami floor 500. In the drawings, the horizontality maintaining portion 396 is shown as entirely covering the lower end of the second part 392.

The first contact portion 395*a* contacts the floor. Consequently, the distance from the bottom of the first contact portion 2395*a* to the floor is equal to or less than the distance from the bottom of the horizontality maintaining portion 396 to the floor.

The horizontality maintaining portion 396 may be formed of a flexible material, such as a brush, rubber, sponge or fiber, to minimize damage to the tatami floor 500.

The operation of the blade assembly 382 shown in FIGS. 12 and 13 may be easily understood with reference to FIGS. 7 to 11, and therefore, a description thereof will not be given.

As is apparent from the above description, the blade of the autonomous cleaning device is prevented from becoming misaligned due to assembly tolerance or injection tolerance, and the blade is prevented from moving off of a floor, thereby improving cleaning performance.

Also, generation of noise due to abnormal contact between the blade and the floor during travel of the autonomous cleaning device is prevented.

Also, the blade is prevented from being bent, thereby securing travel and cleaning performance of the autonomous cleaning device.

Also, the shape of the blade assembly is approximated to the rotational arc of the brush, thereby improving cleaning performance of the autonomous cleaning device.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An autonomous cleaning device comprising:

a main body having an opening;

a brush unit rotatably provided in the opening of the main body; and a blade assembly to guide introduction of dust swept up by the brush unit, wherein the blade assembly comprises:

a blade extended toward a floor, the blade having a contact portion to contact with the floor; and a maintaining portion located behind the contact portion in the direction of travel, the maintaining portion formed of a material different from that of the contact portion, wherein the maintaining portion is attached to a bottom surface of the blade, the maintaining portion is maintained on the floor during the travel of the cleaning device such that the contact portion can move across the floor without the contact portion falling into any crevices or valleys of the floor.

2. The autonomous cleaning device according to claim 1, wherein the maintaining portion is disposed in a longitudinal direction of the blade.

3. The autonomous cleaning device according to claim 1, wherein the blade adapted to bend downward when the contact portion establishes frictional contact with the floor.

4. The autonomous cleaning device according to claim 1, wherein the maintaining portion is formed of the material exhibiting frictional force lower than that of the contact portion.

5. The autonomous cleaning device according to claim 4, wherein the blade is formed of a rubber material and the maintaining portion is formed of a fiber material.

6. The autonomous cleaning device according to claim 4, wherein the blade is formed of a rubber material and the maintaining portion is formed of a sponge material.

7. The autonomous cleaning device according to claim 1, wherein the maintaining portion serves to collect residual dust that has not been swept up by the brush unit.

8. The autonomous cleaning device according to claim 1, wherein the floor is a tatami floor.

* * * * *